US009805885B2

(12) United States Patent
Francis et al.

(10) Patent No.: US 9,805,885 B2
(45) Date of Patent: Oct. 31, 2017

(54) ROTARY SWITCH

(71) Applicant: Redarc Technologies Pty Ltd, Morphett Vale (AU)

(72) Inventors: Roderick M. Francis, Clayton, NC (US); Jon R. Thompson, Pine Level, NC (US)

(73) Assignee: REDARC TECHNOLOGIES PTY LTD, Lonsdale, South Australia (AU)

( * ) Notice: Subject to any disclaimer, the term of this patent is extended or adjusted under 35 U.S.C. 154(b) by 128 days.

(21) Appl. No.: 14/974,185

(22) Filed: Dec. 18, 2015

(65) Prior Publication Data

US 2016/0181031 A1 Jun. 23, 2016

Related U.S. Application Data

(60) Provisional application No. 62/093,714, filed on Dec. 18, 2014.

(51) Int. Cl.

| | |
|---|---|
| ***H01H 9/38*** | (2006.01) |
| ***H01H 19/10*** | (2006.01) |
| ***H01H 33/12*** | (2006.01) |
| ***H01H 19/06*** | (2006.01) |

(52) U.S. Cl.

CPC ..... *H01H 19/10* (2013.01); *H01H 9/38* (2013.01); *H01H 19/06* (2013.01); *H01H 33/12* (2013.01)

(58) Field of Classification Search

CPC ..... H01H 19/38; H01H 19/42; H01H 19/10; H01H 19/06; H01H 19/36; H01H 9/38; H01H 9/383; H01H 9/386; H01H 31/14; H01H 31/16; H01H 31/18; H01H 31/20; H01H 33/12; H01H 33/121; H01H 33/123; H01H 33/124

USPC ..... 200/336, 564

See application file for complete search history.

(56) References Cited

U.S. PATENT DOCUMENTS

| | | | | |
|---|---|---|---|---|
| 3,862,383 A * | 1/1975 | Bednarek | H01H 19/10 | 200/14 |
| 6,194,984 B1 * | 2/2001 | Kappel | H01H 50/546 | 335/132 |
| 7,777,147 B2 * | 8/2010 | Wong | H01H 19/10 | 200/11 R |

* cited by examiner

*Primary Examiner* — Felix O Figueroa
(74) *Attorney, Agent, or Firm* — Michael Best & Friedrich LLP

(57) ABSTRACT

The present invention relates to a rotary switch. In particular, the rotary switch includes a main contactor having a main contact carrier and a main cam, a shaft rotatably journaled in the main contactor and extending axially through the main contactor, and an auxiliary contactor. When the switch is rotated from the ON position to the OFF position, the shaft rotates to break open auxiliary contacts before main contacts break open upon further rotation of the shaft.

13 Claims, 9 Drawing Sheets

ROTARY SWITCH

RELATED APPLICATIONS

This application claims priority to U.S. Provisional Application No. 62/093,714, filed on Dec. 18, 2014, the entire contents of which are hereby incorporated by reference.

BACKGROUND

In some existing switches, especially switches for high current switching applications damage can be caused by arcing occurring between contacts of the switches when the contacts are opening or closing during operation of the switch. In particular, the energy developed by the arc—which develops between the two contacts (e.g. electrodes) when they transition from a closed position to an open position or from an open to a closed position—degrades the material of the contacts over time and thus reduces the life span of the switch. The arc that develops when the contacts transition from the closed position to the open position (i.e. a break arc) is typically more energetic and more destructive than the arc that develops when the contacts transition from the open position to the closed position (i.e. an open arc).

Also, when these existing switches are used in some high current switching applications, such as vehicle or marine applications, other components of the electrical systems of the vehicle or boat can be detrimentally affected by load dump when the contacts of the switch transition from the closed position to the open position. That is, in this case, for instance, the switch is a battery isolation switch which isolates the battery from an alternator and, when the contacts of the switch transition from the closed position to the open position, the battery being charged is disconnected and components connected to the battery will receive a potentially damaging surge in power.

One existing example of an attempt to minimize load dump in the above mentioned applications and arcing in a switch, and thus minimize damage to the contacts and the components of an electrical system includes using multiple contacts that open and close sequentially at different times to operate the switch. In this example, however, the first contact to make contact and/or the last contact to break will experience the greatest contact wear and eventually will form a high-resistance connection that can cause, for example, excessive heating inside the switch. Another existing example employs auxiliary contacts in addition to the main contacts, which are generally rated for less current than the main contacts, and which are intended to break before main contacts of the switch using an electronic timing circuit. The auxiliary contacts, when breaking before the main contacts, minimize the energy that can be developed by the break arc between the main contacts. In this example, however, the auxiliary contacts can be degraded over time and the electronic timing circuits can fail so as to not ensure the auxiliary contacts are always broken before the main contacts. Also, the electronic delay circuits are generally non-compliant with hazardous/explosive area codes and can be unreliable.

SUMMARY

The present invention relates to a rotary switch. In particular, the rotary switch includes a main contactor having a main contact carrier and a main cam, a shaft rotatably journaled in the main contactor and extending axially through the main contactor, and an auxiliary contactor.

When the switch is rotated from the ON position to the OFF position, the shaft rotates to break open auxiliary contacts before main contacts break open upon further rotation of the shaft.

The present invention has particular, but not exclusive, application in high current switching applications, such as battery isolation switches for vehicles.

In one embodiment, the invention provides a rotary switch that has a main contactor including a main contact carrier and a main cam. The rotary switch also includes a shaft rotatably journaled in the main contactor and extending axially through the main contactor. The shaft is rotable between a first position in which the switch is in an OFF position and a second position in which the switch is in an ON position. The main contact carrier and the main cam are driven apart axially upon rotation of the shaft to the second position to drive main contacts on the main contact carrier to contact against main contacts on corresponding terminals of the switch when the switch is in the ON position. Additionally, the rotary switch includes an auxiliary contactor including auxiliary contacts and an auxiliary cam secured at a distal end of the shaft. The auxiliary cam co-acts with the auxiliary contactor upon rotation of the shaft between the first and second positions to open and close the auxiliary contacts. The rotary switch has a rod extending radially from the shaft. The main cam has a rod receiving portion defined by at least one arcuate portion having a radially extending opening driving surface, a radially extending closing driving surface and a gap therebetween. The rod urges against the closing driving surface upon rotation of the shaft to the second position and urges against the opening driving surface upon rotation of the shaft to the first position. When the switch is rotated from the ON position to the OFF position, the shaft rotates from the second position and the auxiliary cam co-acts with the auxiliary contactor to break open the auxiliary contacts while the rod rotates in the gap of the rod receiving portion until reaching the opening driving surface of the rod receiving portion so that the auxiliary contacts break open before the main contacts on the main contact carrier break open from the main contacts on the corresponding terminals as the main contact carrier and the main cam are driven together axially upon further rotation of the shaft to the first position.

In some embodiments, the switch is a battery isolation switch which can be used for vehicles or marine applications which require high current switching. Also, the switch can be used in applications that require an explosion proof rating due at least in part to the reliability of the auxiliary contacts breaking open before the main contacts. In this application, the main contactor includes a main contactor housing capable of achieving an explosion proof rating for the battery isolation switch.

As discussed, in such high current applications, arcing between main contacts can degrade the main contacts and ultimately degrade the switch. The above embodiment, on the other hand, prevents the main contacts from breaking before the auxiliary contacts break to reduce arcing between the main contacts by, at least in part, the auxiliary cam being secured directly to the shaft and directly driven upon rotation of the shaft, and the configuration of the main cam providing a mechanical delay for the main contacts.

The switch can also include a handle attached to a proximal end of the shaft for rotating the switch by a user between the ON and OFF positions.

In some embodiments, the main contactor also includes a latch to further prevent the main contacts before being unlatched. In this case, the latch is unlatched when the shaft rotates from the second position and the rod rotates in the gap of the rod receiving portion. This embodiment prevents the main contacts from inadvertently breaking before the auxiliary contacts break by action of the latch. That is, the shaft is secured directly to the auxiliary cam and rotates in such a manner so as to ensure the auxiliary contacts break while the latch on the main contacts is released.

In a variant of the embodiment, the main cam includes a latch receiving portion configured to receive a latch head at a distal end of a latch arm of the latch. The latch includes a pivot at a proximal end of the latch arm, and the latch head is pivotally biased to be received in the latch receiving portion by a biasing means attached to the pivot. The switch also includes a latch release pin attached to a distal end of the rod, and the latch release pin is configured to urge the latch head from the latch receiving portion when the shaft rotates from the second position and the rod rotates in the gap of the rod receiving portion. Thus, the latch ensures no movement of the main contacts before latch release and that the auxiliary contacts have completed a change of state to be open at the point of latch release. This action of the switch is controlled by geometry of the components of the switch and the latch.

In another variant of the embodiment, the components of the switch are made from a hard plastics material, except the contacts, so that the components are not generally subject to adjustments or affected by wear. Shaft rotation controls auxiliary contact and shaft rotation controls latch release and the difference in these angles is designed into the components of the switch. That is, for instance, the rod receiving portion has a gap with an arcuate angle of, say, 25 degrees so that the shaft can rotate 25 degrees to open the auxiliary contacts and open the latch before the rod urges against the opening driving surface of the rod receiving portion upon further rotation of the shaft to open the main contacts.

In another variant of the embodiment, the shaft is biased to the second position by a biasing means urging against the rod. For instance, the biasing means includes a spring urging against the rod to prevent the shaft from inadvertently rotating to break open the auxiliary contact and release the latch.

In another variant of the embodiment, the main contact carrier and the main cam are driven axially upon rotation of the shaft by at least helical ramp disposed on the main contact carrier and or the main cam.

In some embodiments, the auxiliary contacts are normally closed. For instance, the auxiliary cam is a roller with a detent configured to receive a biased actuator pin of the auxiliary contactor when the auxiliary contacts of the auxiliary contactor are open and when the switch is in the ON position.

Other aspects of the invention will become apparent by consideration of the detailed description and accompanying drawings.

BRIEF DESCRIPTION OF THE DRAWINGS

In order that the invention be more clearly understood, examples of an embodiment will now be described with reference to the accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
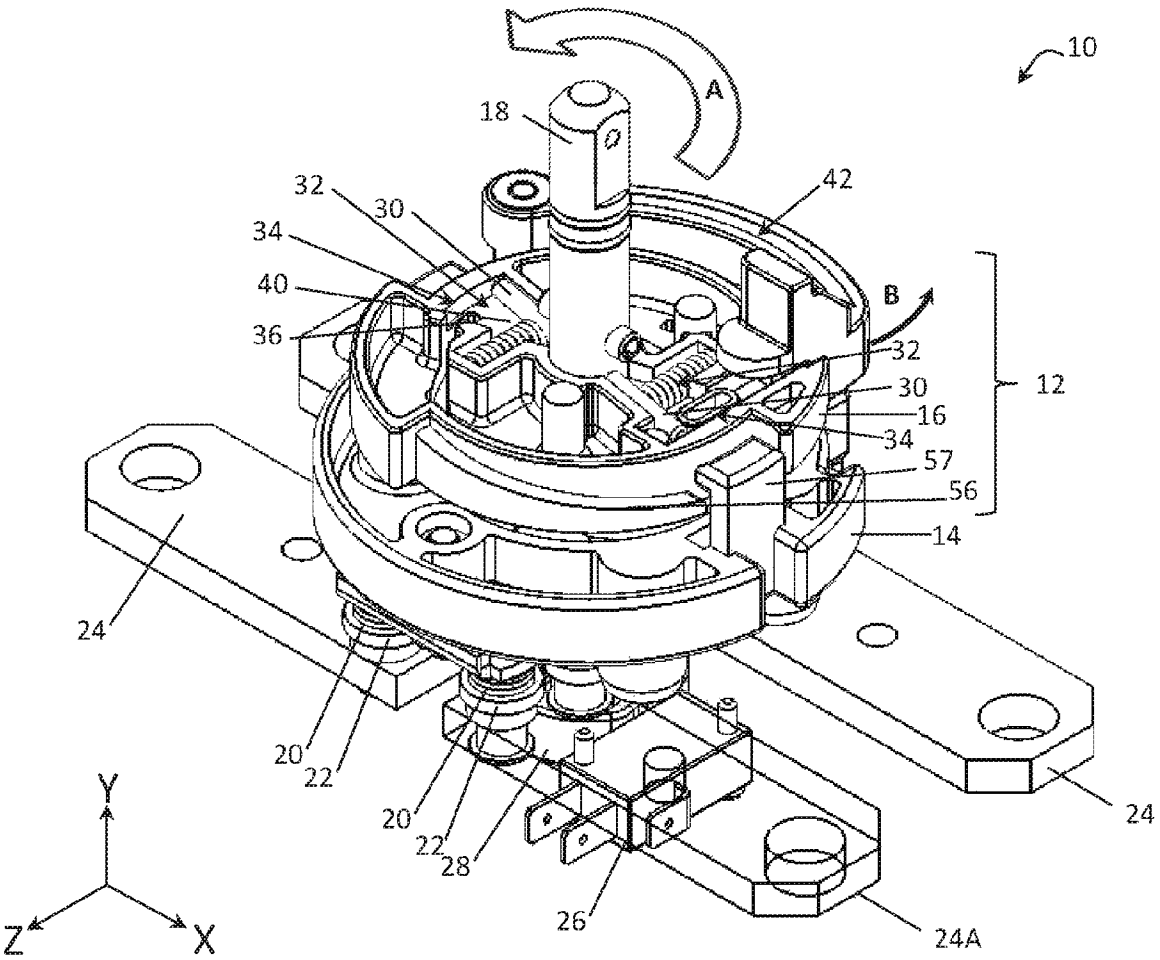
FIG. 1 is a perspective view of a rotary switch in the ON position according to an embodiment of the present invention.
Figure 2:
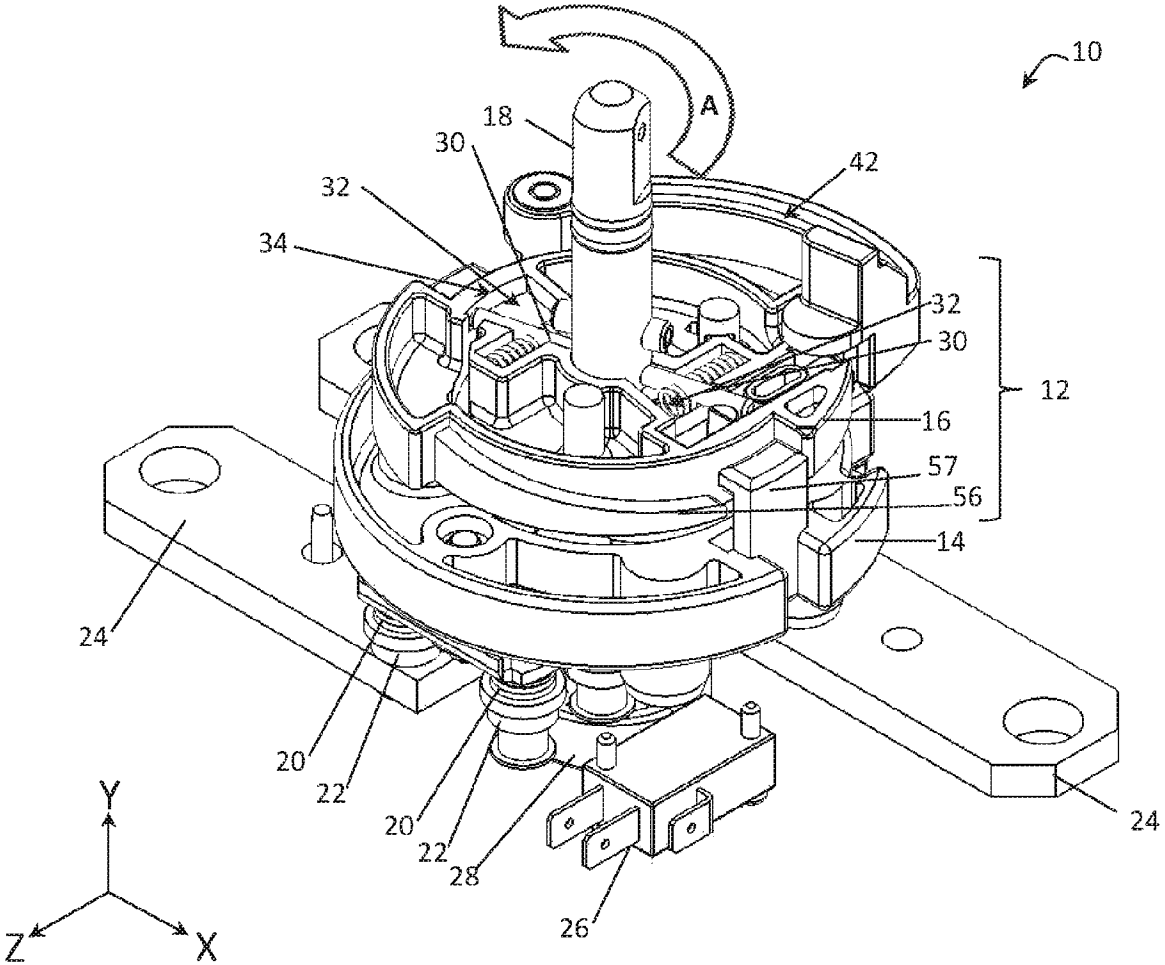
FIG. 2 is a perspective view of the switch of FIG. 1 where the switch is rotated from the ON position towards the OFF position.
Figure 3:
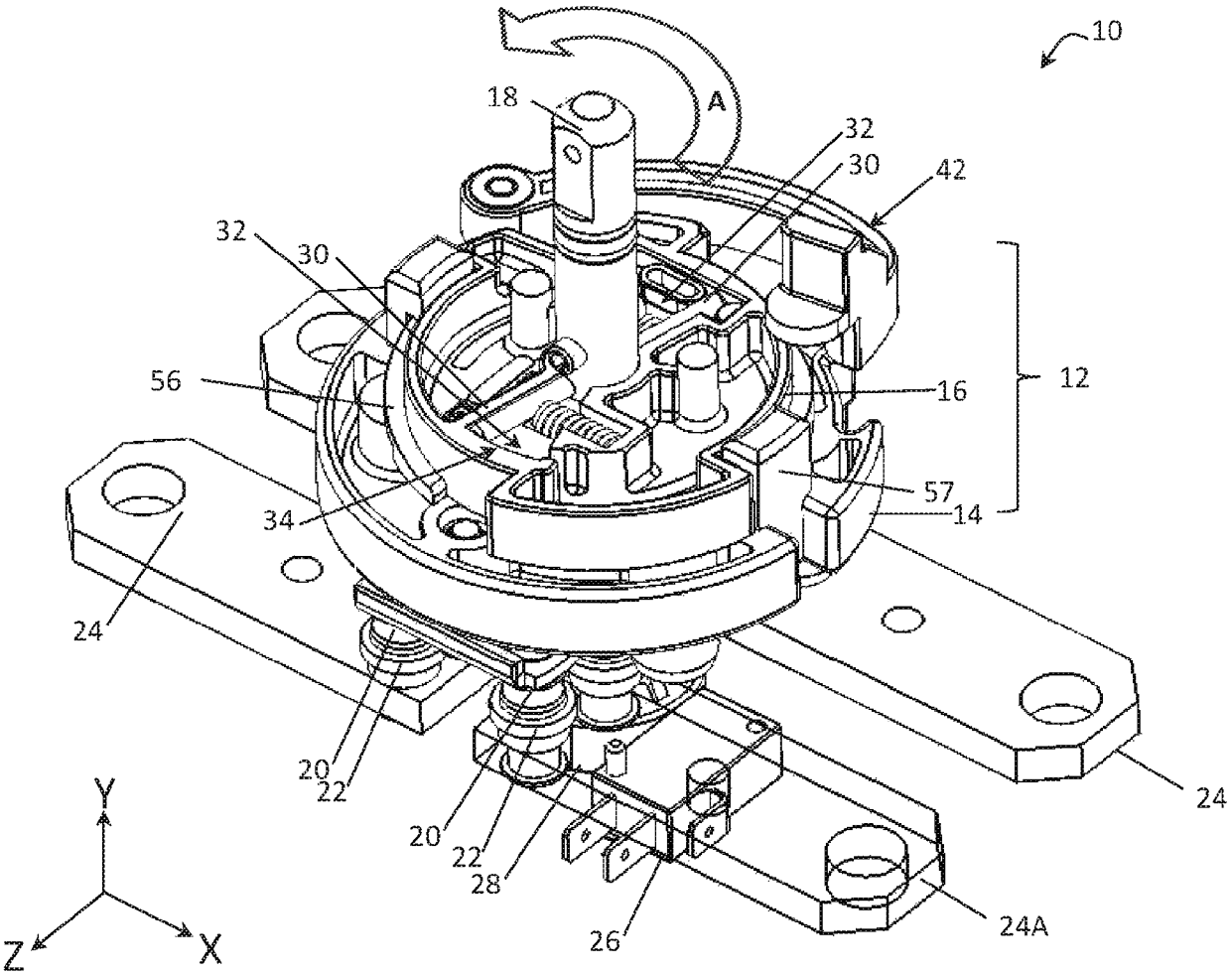
FIG. 3 is a perspective view of the switch of FIG. 1 where the switch is in the OFF position.

According to an embodiment of the present invention, there is provided a rotary switch 10, as shown in the Figures. The rotary switch 10 includes a main contactor 12, including a main contact carrier 14 and a main cam 16, and a shaft 18 rotatably journaled in the main contactor 12 and extending axially through the main contactor 12. It can be seen in FIGS. 1 to 3 that the shaft 18 extends axially in the Y direction and the main contactor 12 extends radially from the shaft 18 in the X-Z plane. In use, the shaft 18 of the switch 10 is rotable between a first position in which the switch is in an OFF position and a second position in which the switch is in an ON position. FIG. 1 shows the switch 10 in the ON position and the shaft 18 in the second position; FIG. 2 shows the switch 10 in a transition position between the ON position and the OFF position; and FIG. 3 shows the switch 10 is in the OFF position and the shaft 18 in the first position.

Also, the main contact carrier 14 and the main cam 16 are driven apart axially upon rotation of the shaft 18 to the second position to drive main contacts 20 on the main contact carrier 14 to contact against main contacts 22 on corresponding terminals 24 of the switch 10 when the switch is in the ON position. That is, the switch is rotated clockwise to the ON position and the switch 10 is rotated in a counterclockwise manner from the ON position to the OFF position in the direction of the arrow A. It will be appreciated by those persons skilled in the art, however, that the switch 10 could be configured to rotate in the opposite directions in another embodiment. Also, it will be appreciated that a handle is normally attached to the proximal end of the shaft 18 for rotating the switch 10 by a user between the ON and OFF positions.

Figure 4:
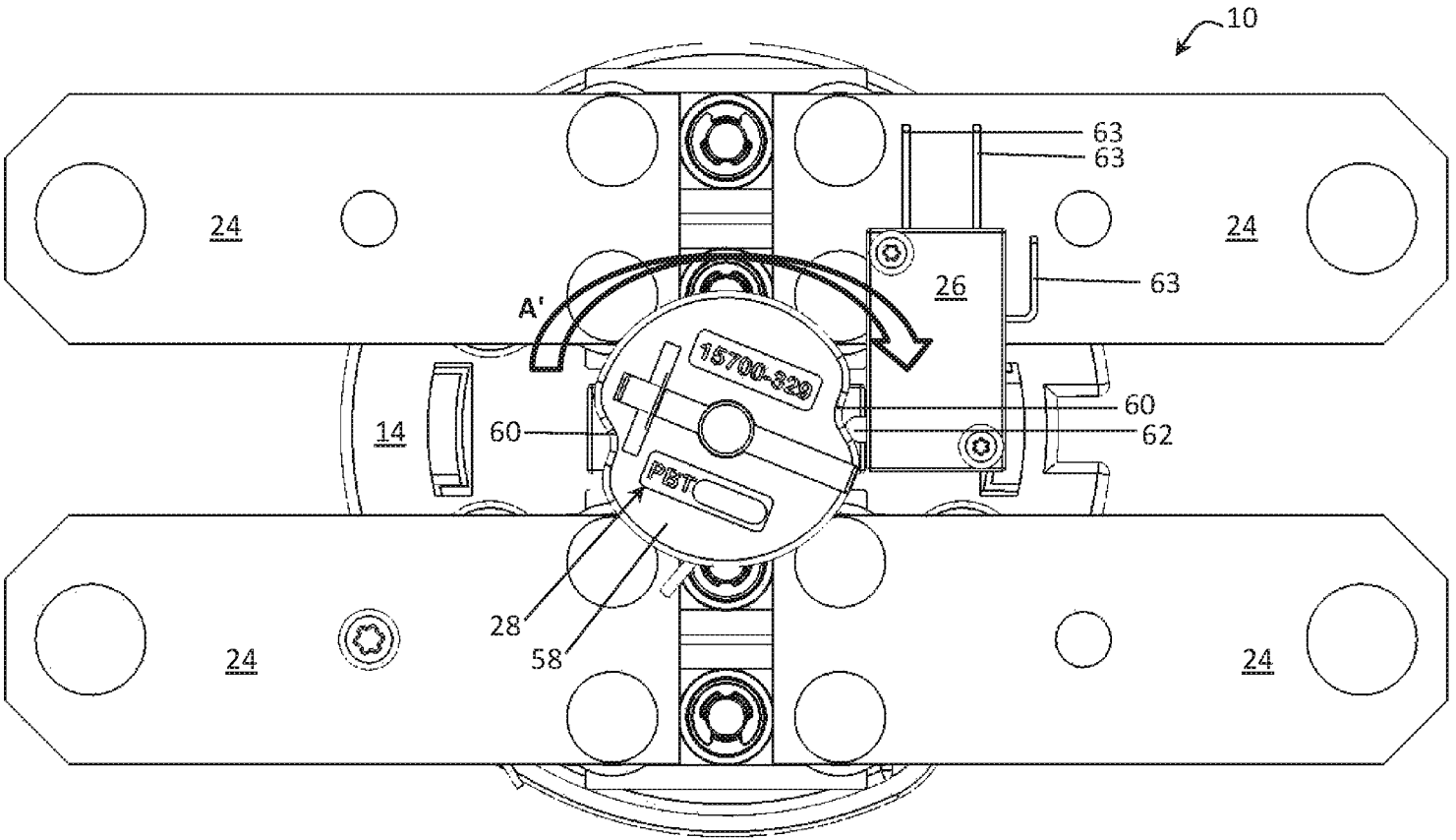
FIG. 4 is a bottom view of the switch of FIG. 1 in the OFF position.
Figure 5:
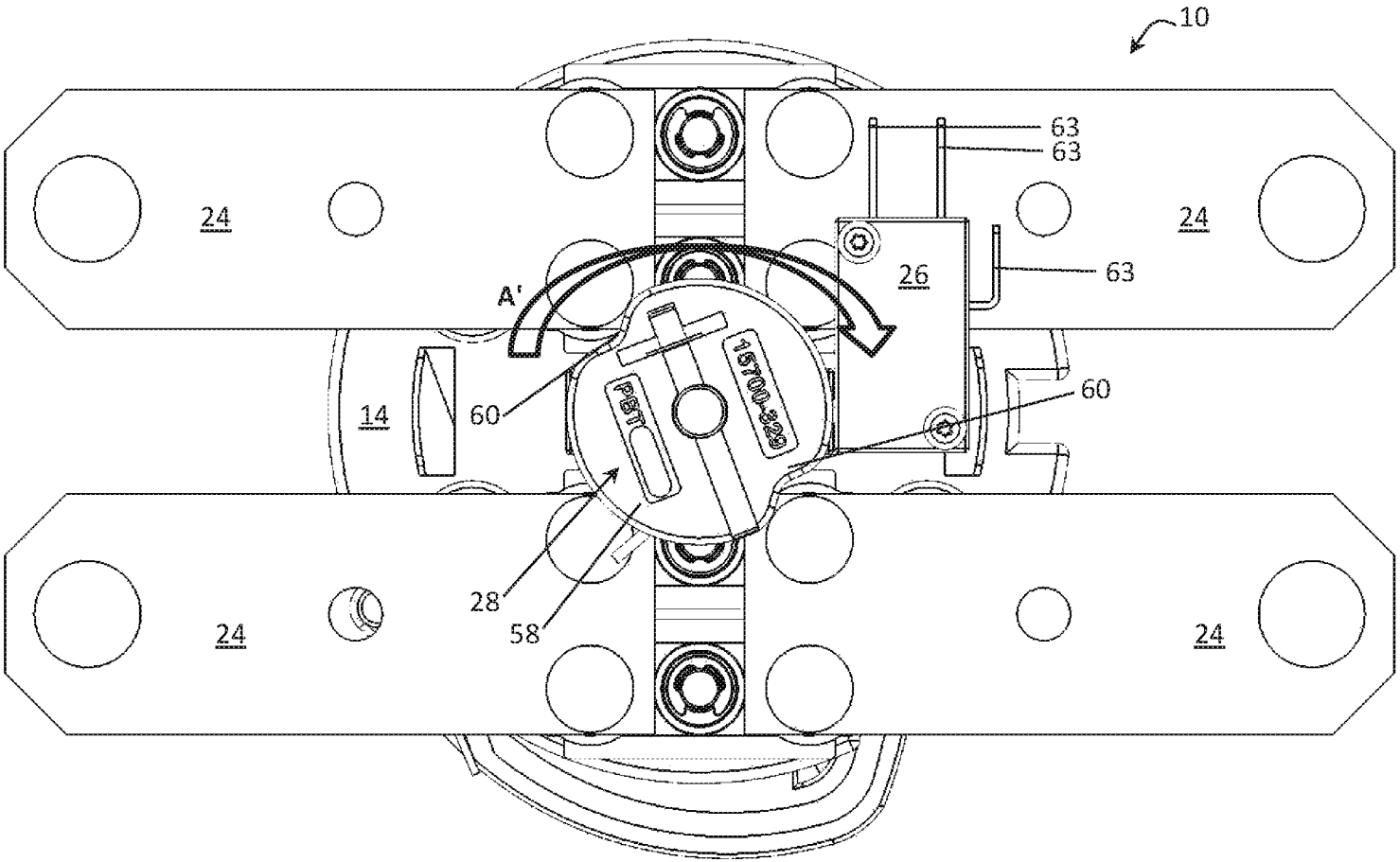
FIG. 5 is a bottom view of the switch of FIG. 1 where the switch has been rotated from the ON position towards the OFF position.
Figure 6:
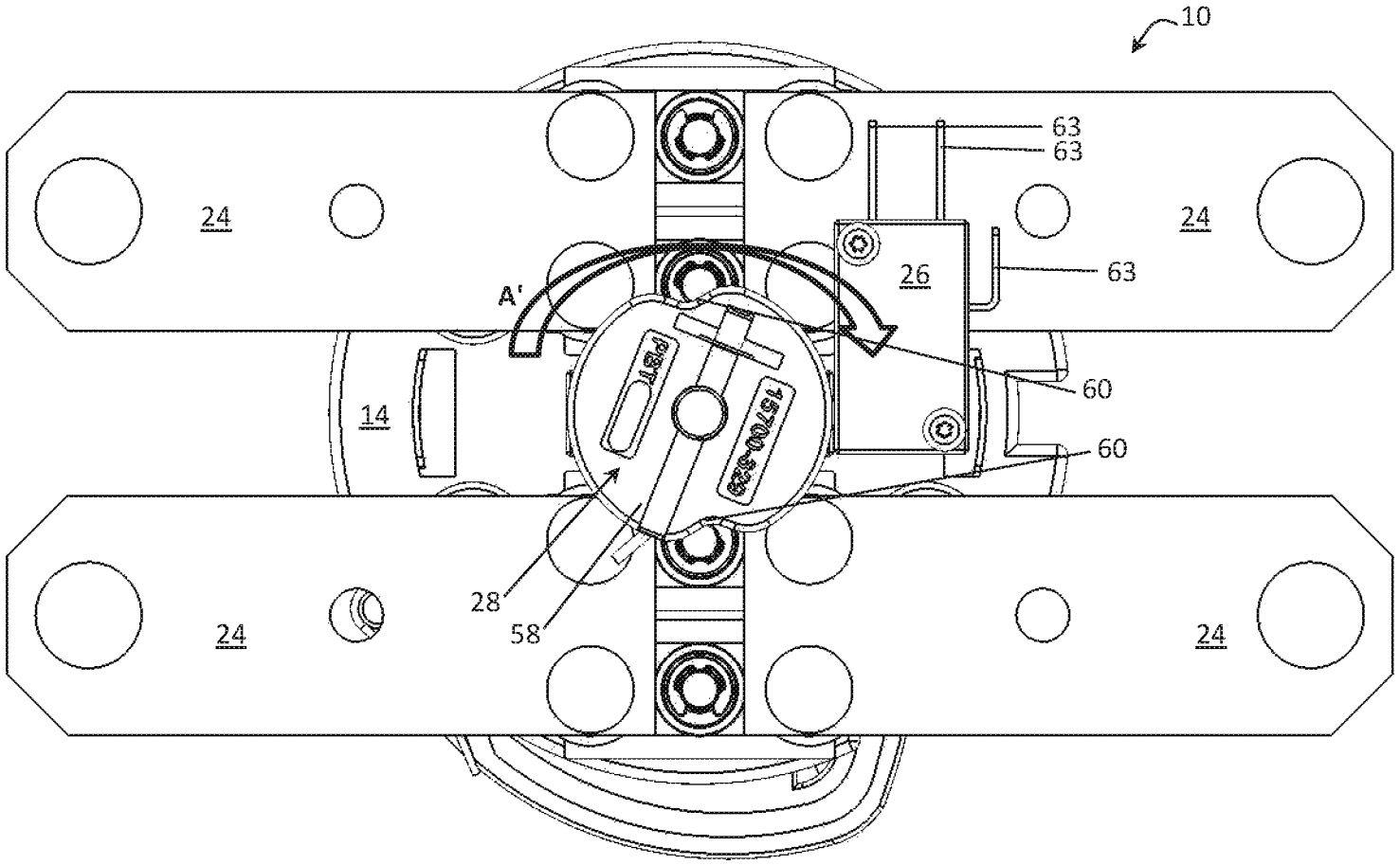
FIG. 6 is a bottom view of the switch of FIG. 1 where the switch is in the OFF position.

In the embodiment, the switch 10 also includes an auxiliary contactor 26 including auxiliary contacts. The terminal 24A is shown in FIGS. 1 and 3 in a transparent form so that the auxiliary contactor 26 can be seen therethrough (it is removed from view in FIG. 2). Further, the switch 10 includes an auxiliary cam 28 secured at a distal end of the shaft 18. The auxiliary cam 28 is secured directly to the shaft 18 and co-acts with the auxiliary contactor 26 upon rotation of the shaft 18 between the first and second positions to open and close the auxiliary contacts. Further detail of the auxiliary contactor 26 will be described below with reference to FIGS. 4 to 6.

Figure 7:
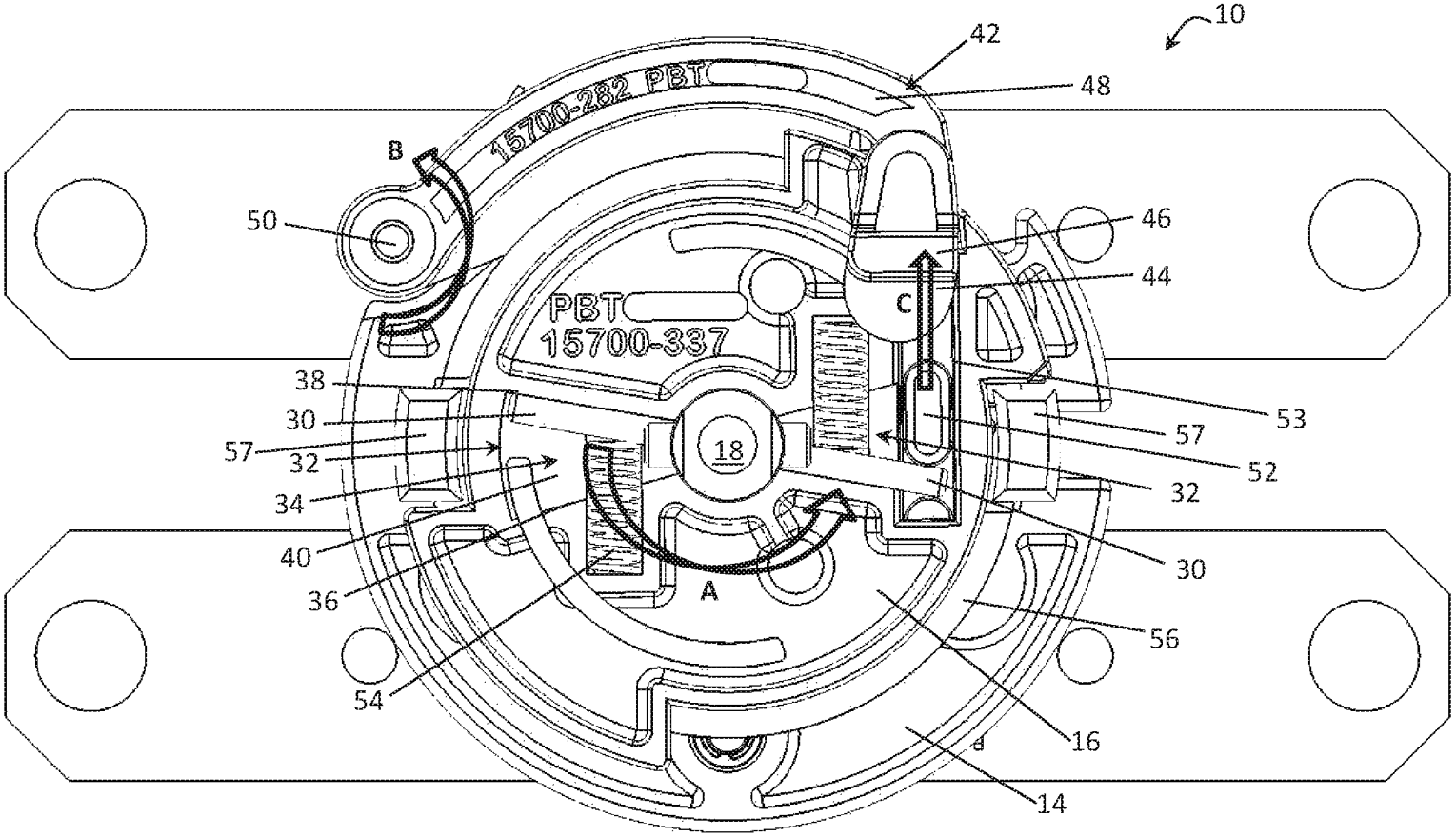
FIG. 7 is a top view of the switch of FIG. 1 in the ON position.
Figure 8:
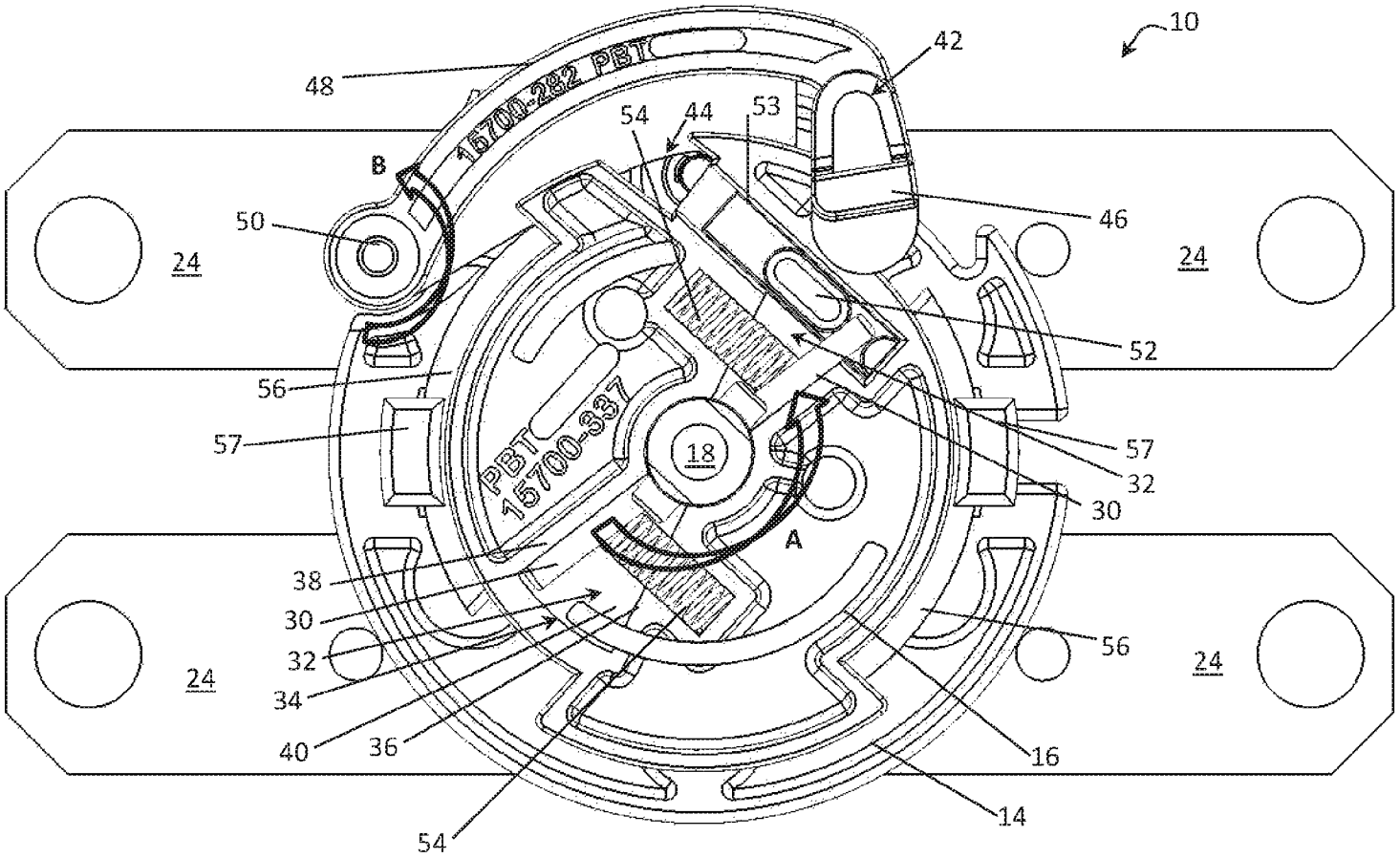
FIG. 8 is a top view of the switch of FIG. 1 where the switch has been rotated from the ON position towards the OFF position.
Figure 9:
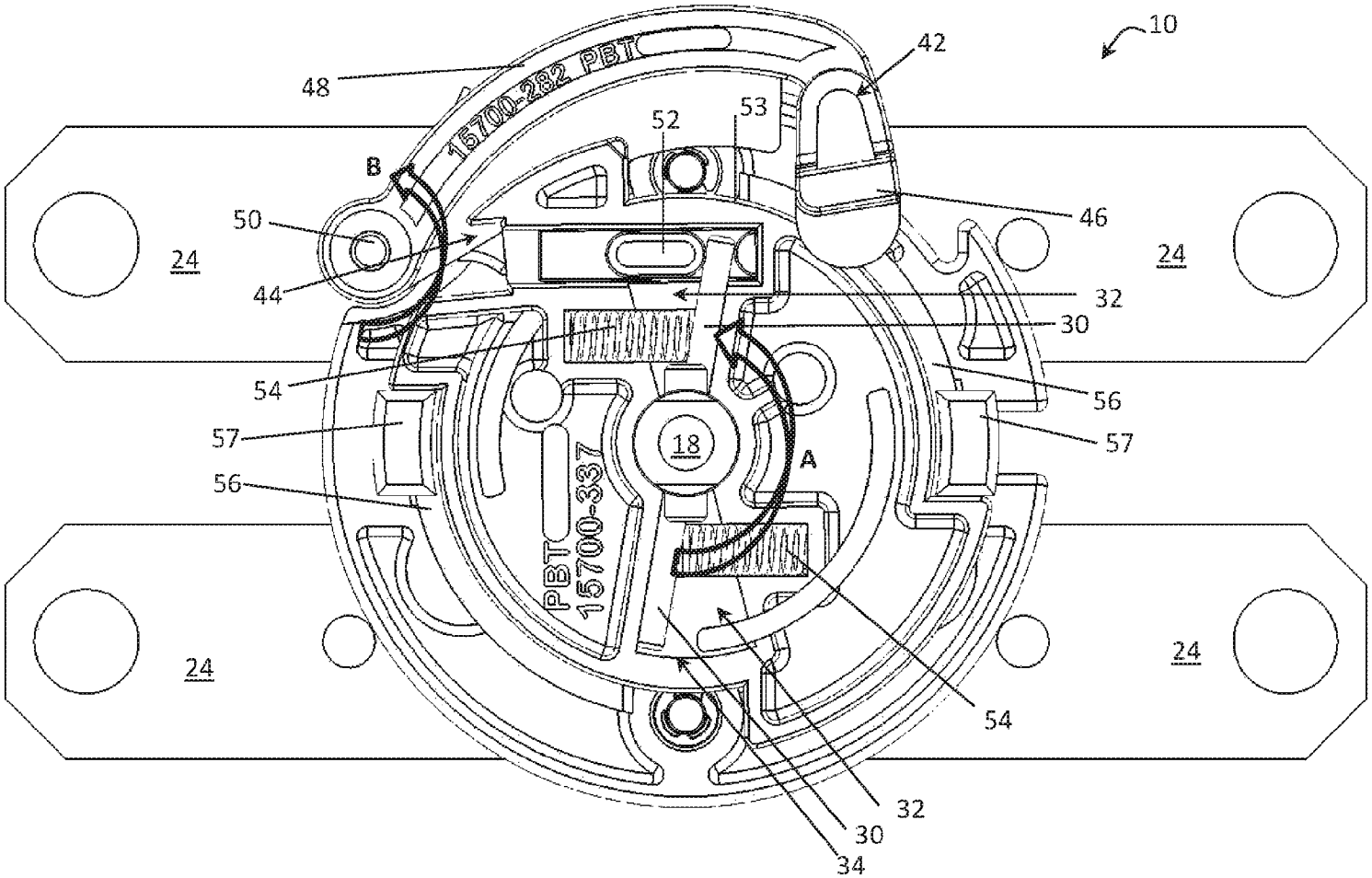
FIG. 9 is a top view of the switch of FIG. 1 where the switch is in the OFF position.

The switch 10 further includes a rod 30 extending radially from the shaft 18, and the main cam 16 has a rod receiving portion 32 defined by at least one arcuate portion 34 having a radially extending opening driving surface 36, a radially extending closing driving surface 38 and a gap 40 therebetween. The rod receiving portion 32 is shown in FIGS. 7 to 9. Referring back to FIG. 1, the switch 10 can be seen as being in the ON position and the shaft is in the second position. When rotational force is applied to the handle on the shaft 18 in the direction of arrow A by a user, the switch 10 is rotated from the ON position to the OFF position. The auxiliary cam 28 co-acts with the auxiliary contactor 26 to break open the auxiliary contacts while the rod 30 rotates in the gap 40 of the rod receiving portion 32 until reaching the opening driving surface 36 of the rod receiving portion 32 so that the auxiliary contacts break open before the main contacts 20 and 22 break open upon further rotation of the shaft 18 to the first position when the switch is in the OFF position. FIG. 2 shows the auxiliary contacts broken open and the main contacts 20 and 22 in contact. Upon further rotation of the shaft 18 from the position shown in FIG. 2 towards the first position, the rod 30 urges against the opening driving surface 36 and the main cam 16 and the main contact carrier 14 are driven together to break apart the main contacts 20 on the main contact carrier 14 from the main contacts 22 on the terminals 24 of the switch 10. To bring the switch 10 back to the ON position and to close the main and auxiliary contacts again, the handle and the shaft 18 of the switch 10 are rotated clockwise by a user and the rod 30 urges against the closing driving surface 38 of the rod receiving portion 32 so that the main contact carrier 14 and the main cam 16 are driven apart axially to drive the main contacts 20 on the main contact carrier 14 to contact against the main contacts 22 on corresponding terminals 24 of the switch 10.

More specifically, in the embodiment shown in the Figures, the main contact carrier 14 and the main cam 16 are driven apart and driven together axially upon rotation of the shaft 18 by helical ramps 56 disposed on the cam 16 and corresponding ramp guides 57 disposed on the main contact carrier 14. It will be appreciated by those persons skilled in the art, however, that the helical ramps 56 and ramp guides 57 may be incorporated into the main contact carrier 14 or the main cam 16 or both to enable the main contact carrier 14 and the main cam 16 to be driven to open and close the main contacts.

As described, in one application, the switch 10 is a battery isolation switch, which may have a main contactor housing capable of achieving an explosion proof rating. Nonetheless, in this application, the terminals 24 carry DC power from a battery to components that require power via the switch 10. In the example where the battery isolation switch 10 is used with respect to a vehicle, the components include the starter motor, alternator, etc. of the vehicle.

Also, in a variant of the embodiment, the main contactor 12 includes a latch 42 to prevent the main contacts 22 breaking open before the latch 42 is unlatched. FIGS. 7 to 9 show the operation of the latch 42 more clearly. Here, it can be seen that the latch 42 is unlatched when the shaft 18 rotates from the second position in FIG. 7 which causes the rod 30 to rotate in the gap 40 of the rod receiving portion 32. Specifically, in the embodiment shown in the Figures, the main cam 16 includes a latch receiving portion 44 in the form of a substantially semi-circular gap in the main cam 16 configured to receive a latch head 46, with a corresponding substantially semi-circular shape, at a distal end of a latch arm 48 of the latch 42. The latch 42 also includes a pivot 50 at a proximal end of the latch arm 48 so that the latch head 46 can be pivoted around the pivot 50. Also, the latch head 46 is pivotally biased to be received in the latch receiving portion 44 by a biasing means attached to the pivot 50. For instance, the biasing means is a split spring with one arm connected to the main cam 16 and the other arm connected to the latch arm 48 to prevent the latch 42 from being inadvertently unlatched.

To operate the latch 42, the switch 10 includes a latch release pin 52 attached to a distal end of the rod 30 configured to be moved in the direction of arrow C within the confines of a latch release pin guiding portion 53 of the main cam 16 in the direction of arrow C. As described, the latch arm 48 pivots about the pivot 50 in the direction of arrow B as the latch release pin 52 urges the latch head 46 to move away from the latch receiving portion 44 when the shaft 18 rotates from the second position and the rod 30 rotates in the gap 40 of the rod receiving portion 32. In this manner, the switch 10 ensures that the auxiliary contacts are broken before the main contacts as the main contacts are latched closed while the auxiliary contacts are broken.

It can also be seen in these Figures that the shaft 18 is biased to the second position by a rod biasing means 54 urging against the rod 30 to further ensure that the auxiliary contacts are broken before the main contacts. The rod biasing means 54 in this embodiment includes two coiled springs, each with one end disposed on the main cam 16 and the other end disposed on the rod 30. Also, in this embodiment, the rod 30 extends radially from the shaft 18 in opposed directions from the shaft 18. Accordingly, the rod receiving portion 32 of the main cam 16 has two radially opposed arcuate portions 34, each having the radially extending opening driving surface 36 and the radially extending closing driving surface 38.

Also, in the embodiment shown in the Figures, the gap 40 between the opening 36 and closing 38 driving surfaces extends in an arcuate manner for an angle of rotation of 25 degrees. That is, the shaft 18 rotates from the second position for 25 degrees to break open the auxiliary contacts and unlatch the latch 42 before rotating further to break open the main contacts 22. The arcuate portions 34, extending for a 25 degree shaft rotation, therefore provide a rotational hysteresis of 25 degrees for the switch 10 for breaking the main contacts. As described, in some embodiments, the auxiliary contacts are normally closed. In the embodiment shown in FIGS. 4 to 6, the auxiliary cam 28 is a roller 58 with a detent 60 configured to receive a biased actuator pin 62 of the auxiliary contactor 26 when the auxiliary contacts of the auxiliary contactor 26 are open and when the switch 10 is in the ON position. That is, the auxiliary contacts are normally closed when the auxiliary cam 28 acts upon the biased actuator pin 62 of the auxiliary contactor 26 to retain the auxiliary contacts in the normally closed position. It can be seen in these Figures that the auxiliary cam 28 rotates in a clockwise direction in the direction of arrow A' when the switch 10 is viewed from the bottom and the auxiliary cam 28 acts upon the biased actuator pin 62 for the majority of the rotational movement of the roller 58 until reaching either one of the detents 60 when the normally closed auxiliary contacts are then opened. It will be also appreciated that auxiliary contacts could be made to be normally open and the roller 58 could have a projection to engage the biased actuator pin 62 of the auxiliary contactor 26 rather than a detent. In any event, the auxiliary contactor 26 has auxiliary terminals 63 for, say, connection to a battery in the application of the switch 10 being a battery isolation switch.

It is to be understood that various alterations, additions and/or modifications may be made to the part specifically described without departing from the ambit of the present invention.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

What is claimed is:

1. A rotary switch, including:

a main contactor including a main contact carrier and a main cam;

a shaft rotatably journaled in the main contactor and extending axially through the main contactor, wherein the shaft is rotable between a first position in which the switch is in an OFF position and a second position in which the switch is in an ON position, and wherein the main contact carrier and the main cam are driven apart axially upon rotation of the shaft to the second position to drive main contacts on the main contact carrier to contact against main contacts on corresponding terminals of the switch when the switch is in the ON position;

an auxiliary contactor including auxiliary contacts;

an auxiliary cam secured at a distal end of the shaft, wherein the auxiliary cam co-acts with the auxiliary contactor upon rotation of the shaft between the first and second positions to open and close the auxiliary contacts; and a rod extending radially from the shaft, wherein the main cam has a rod receiving portion defined by at least one arcuate portion having a radially extending opening driving surface, a radially extending closing driving surface and a gap therebetween, wherein the rod urges against the closing driving surface upon rotation of the shaft to the second position and urges against the opening driving surface upon rotation of the shaft to the first position, whereby when the switch is rotated from the ON position to the OFF position, the shaft rotates from the second position and the auxiliary cam co-acts with the auxiliary contactor to break open the auxiliary contacts while the rod rotates in the gap of the rod receiving portion until reaching the opening driving surface of the rod receiving portion so that the auxiliary contacts break open before the main contacts on the main contact carrier break open from the main contacts on the corresponding terminals as the main contact carrier and the main cam are driven together axially upon further rotation of the shaft to the first position.

2. A rotary switch as claimed in claim 1, wherein the main contactor includes a latch to prevent the switch rotating to the OFF position before being unlatched.

3. A rotary switch as claimed in claim 2, wherein the latch is unlatched when the shaft rotates from the second position and the rod rotates in the gap of the rod receiving portion.

4. A rotary switch as claimed in claim 3, wherein the main cam includes a latch receiving portion configured to receive a latch head at a distal end of a latch arm of the latch.

5. A rotary switch as claimed in claim 4, wherein the latch includes a pivot at a proximal end of the latch arm, and the latch head is pivotally biased to be received in the latch receiving portion by a biasing means attached to the pivot.

6. A rotary switch as claimed in claim 5, wherein the switch includes a latch release pin attached to a distal end of the rod, and the latch release pin is configured to urge the latch head from latch receiving portion when the shaft rotates from the second position and the rod rotates in the gap of the rod receiving portion.

7. A rotary switch as claimed in claim 1, wherein the shaft is biased to the second position by a biasing means urging against the rod.

8. A rotary switch as claimed in claim 1, wherein the main contact carrier and the main cam are driven axially upon rotation of the shaft by at least one helical ramp disposed on the main contact carrier and or the main cam.

9. A rotary switch as claimed in claim 1, wherein the auxiliary contacts are normally closed.

10. A rotary switch as claimed in claim 9, wherein the auxiliary cam is a roller with a detent configured to receive a biased actuator pin of the auxiliary contactor when the auxiliary contacts of the auxiliary contactor are open and when the switch is in the ON position.

11. A rotary switch as claimed in claim 1, wherein the switch includes a handle attached to a proximal end of the shaft for rotating by a user between the ON and OFF positions.

12. A rotary switch as claimed in claim 1, wherein the switch is a battery isolation switch.

13. A rotary switch as claimed in claim 12, wherein the main contactor includes a main contactor housing capable of achieving an explosion proof rating for the battery isolation switch.

* * * * *